United States Patent [19]

Hodgkinson

[11] 4,101,173

[45] Jul. 18, 1978

[54] ROOF PROP AND PLATFORM MOVABLY MOUNTED ON BOOM OF TUNNELLING MACHINE

[75] Inventor: John Hedley Hodgkinson, Sutton-in-Ashfield, England

[73] Assignee: Coal Industry (Patents) Limited, London, England

[21] Appl. No.: 763,708

[22] Filed: Jan. 28, 1977

[30] Foreign Application Priority Data

Feb. 13, 1976 [GB] United Kingdom ..... 5725/76

[51] Int. Cl.[2] ..... E21D 9/04; E21D 9/10

[52] U.S. Cl. ..... 299/33; 299/11; 299/64; 299/75

[58] Field of Search ..... 299/11, 33, 64, 75, 299/76

[56] References Cited

U.S. PATENT DOCUMENTS 2,659,586 11/1953 Leven ..... 299/64

FOREIGN PATENT DOCUMENTS 1,758,161 1/1971 Fed. Rep. of Germany ..... 299/33

2,547,480 10/1975 Fed. Rep. of Germany ..... 299/33

*Primary Examiner*—Ernest R. Purser

*Attorney, Agent, or Firm*—Stevens, Davis, Miller & Mosher

[57] ABSTRACT

A mineral mining machine of the type having a boom-mounted cutter assembly carried by a mobile base unit is provided with a face support structure which is pivotally mounted on the boom. Fluid operable rams are provided for moving the structure between a stowed position lying adjacent the boom and an operational face supporting position perpendicular to the longitudinal axis of the boom. The face support structure is brought into operation when it is desired to afford temporary support to a face of a ripping lip for example, in arch setting operations. In this latter respect, the boom also carries a stowable platform which can be opened out so that operatives may position themselves to handle arch sections which are elevated into position by a lifting mechanism also pivotally mounted on the boom.

11 Claims, 3 Drawing Figures

ROOF PROP AND PLATFORM MOVABLY MOUNTED ON BOOM OF TUNNELLING MACHINE

This invention concerns improvements in and relating to mineral mining machines.

In particular, the invention has reference to such machines for use in the driving of underground roadways or tunnels or in ripping operations in, for example, coal mines.

One known type of mining machine employed for these purposes (hereinafter referred to as the type described) includes a mobile base unit provided with a forwardly extending cutter-carrying boom which is mounted on the base unit for vertical and horizontal movement, and a conveyor assembly attached to the base unit and extending from the front of the unit to the rear thereof, the conveyor being adapted to collect and convey material at the front of the unit to the rear of the unit for discharge.

When such a machine is used for the purposes set forth in a coal mine, it is customary to provide support for the advancing roadway as it is being cut by the machine. When a D-Section roadway is being formed arch-supports are employed and are set to the roof of the roadway by personnel. The supports are made in a number of sections which have to be fixed together in situ. The uppermost or crown section of the support has hitherto been elevated to the correct height by the boom which has a lifting bracket for the purpose. This may not always be entirely satisfactory since the whole boom has to be moved and thus there is no independent means of elevation. Furthermore, when personnel are working in the vicinity of recently cut strata such for example as exists at a ripping face, it is necessary to provide a temporary support for such strata to prevent or assist in preventing movement of debris toward the area of work. Such temporary support has in the past been provided by a face support mounted on forepoling bars movable in relation to guides on the arch-supports. The setting of such a face support is laborious and time consuming.

It is an object of the present invention to provide a mineral mining machine of the type described incorporating an improved face support.

Accordingly the invention provides a mineral mining machine of the type described including a face support structure pivotally attached to the boom and movable between an inoperative position adjacent the boom to a face supporting position orthogonal or substantially orthogonal to the longitudinal axis of the boom.

The face support structure is conveniently movable by power-operated means, for example fluid operable rams. The structure may include two limbs, one located on either side of the boom and each pivotally attached intermediate its ends to the boom. The structure further includes a support member which is hinged to the two limbs and which, in use, provides an abutment for engagement with a face to be supported.

The mineral mining machine of the present invention further includes a lifting mechanism pivotally mounted on the boom, and actuating means for moving the lifting mechanism.

The boom is conveniently provided with a platform arrangement which may be in two parts, one located to either side of the boom.

Advantageously the platform arrangement is adapted to be stowed when not in use.

By way of example only, one embodiment of a mineral mining machine according to the invention is described below with reference to the accompanying drawings in which.

Figure 1:
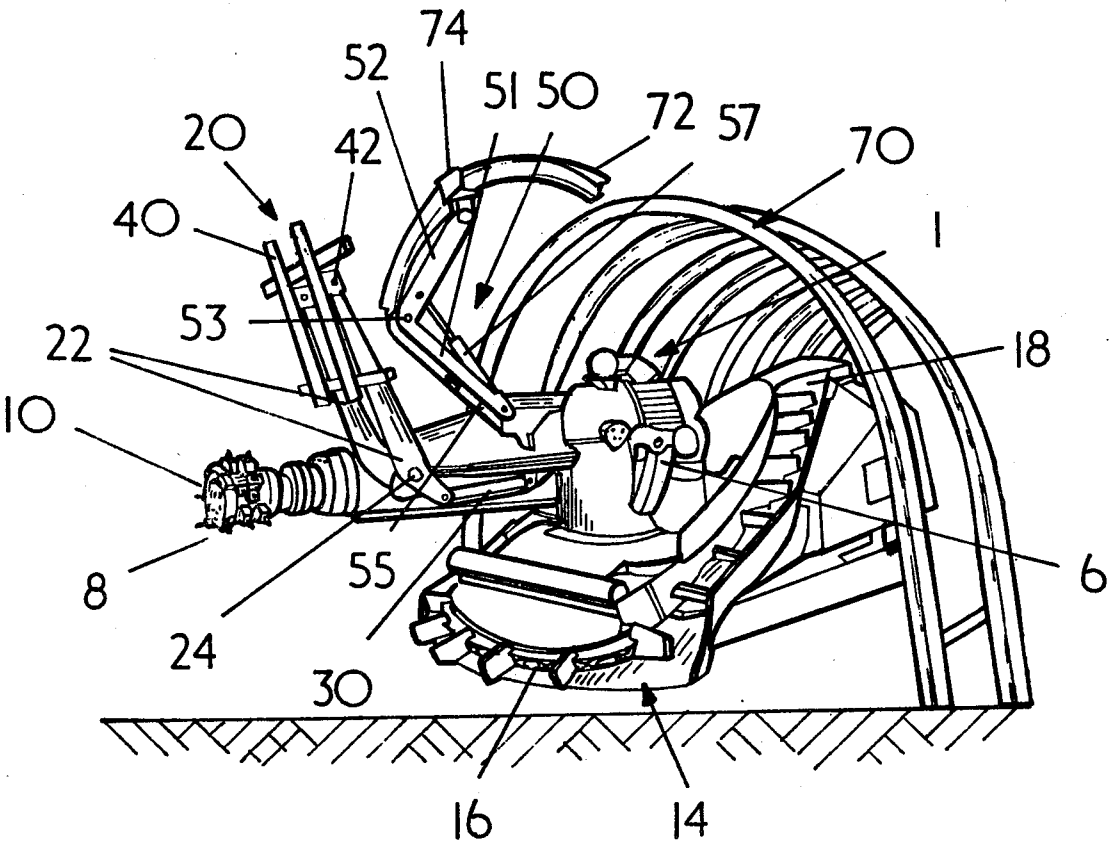
FIG. 1 is a perspective view looking at the front of the machine.

Referring to the drawings, a mineral mining machine is depicted at 1 and includes a mobile base unit 2 comprising crawler tracks 4. A rotatable turret 6 is mounted on the unit 2 and carries a trunnion mounting for a boom 8 which carries at its forward end a cutter head 10. The drive motor for the cutter head is shown at 12. As can be seen, particularly from FIG. 1, a conveyor assembly 14 is provided on the machine 1 and comprises a "round-the-houses" type conveyor 16 which extends from floor level at the front of the machine to an elevated location towards the rear thereof, there being a discharge station for the conveyor 16 at 18.

A face support structure 20 is pivotally mounted on the boom 8 at a location remote from the motor 12. The structure 20 includes two side limbs 22 each pivoted at 24 on a bracket 26 attached to the boom 8. Each limb 22 is pivoted intermediate its ends and at its lower end is attached to the rod 28 of a hydraulically actuable ram 30 which has its cylinder 32 secured to a rear bracket 34.

Figure 2:
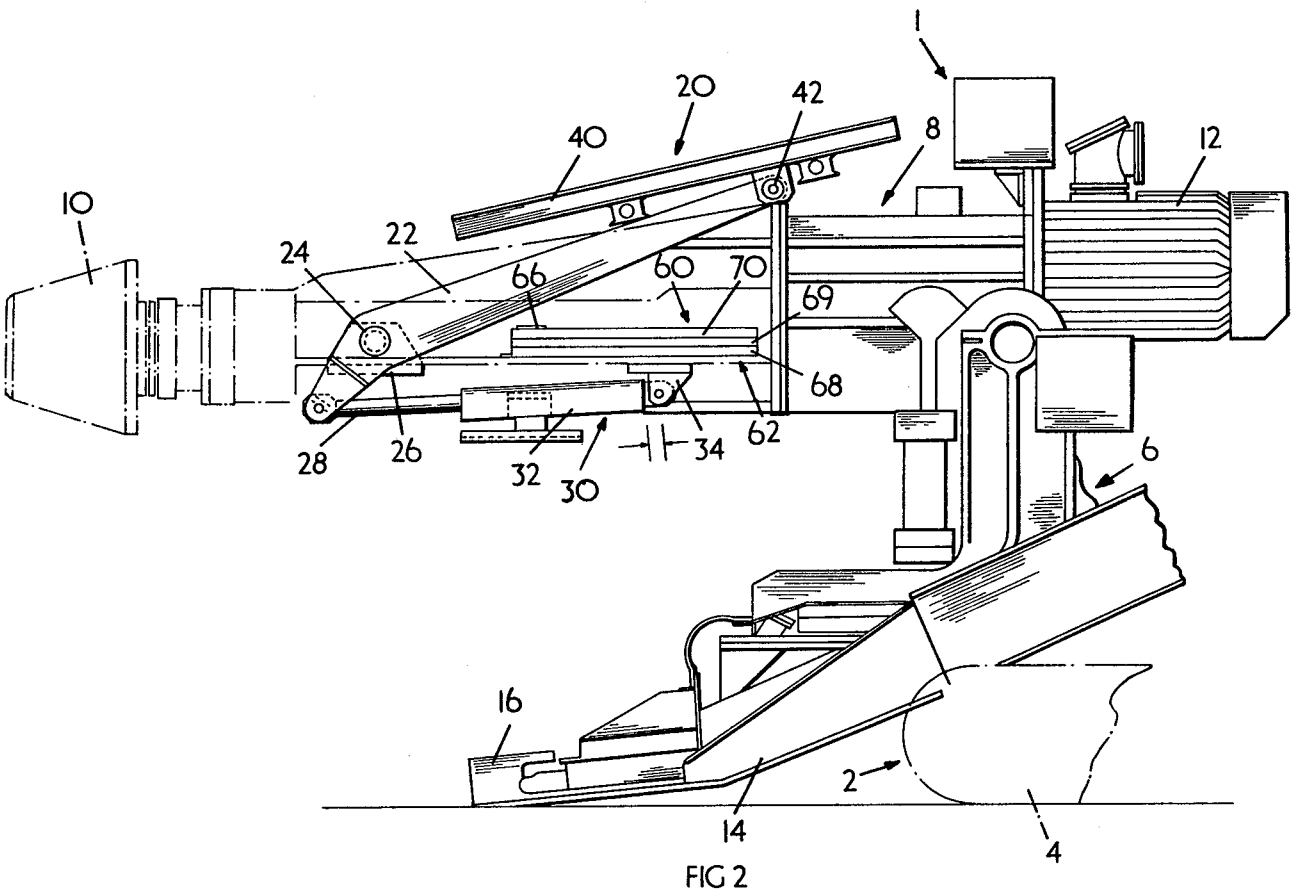
FIG. 2 is a partial side view of the machine.

A support member 40 forms part of the structure 20 and is pivotally mounted at 42 to the side limbs 22 as can more clearly be seen in FIG. 2. The member 40 comprises longitudinal and transverse members 44, 46 respectively which in use present a supporting array to a face to be supported.

Also mounted on the boom 8 is a lifting mechanism 50 (see FIG. 1) pivotally attached thereto and comprising two portions 51, 52 hinged together at 53. Actuating means in the form of rams 55 are arranged to operate between the boom 8 and the portion 51 to elevate the portions 51 and 52 in relation to the boom. Further actuating means in the form of rams 57 are provided between the portions 51, 52 and are adapted to elevate the portion 52 in relation 51.

Figure 3:
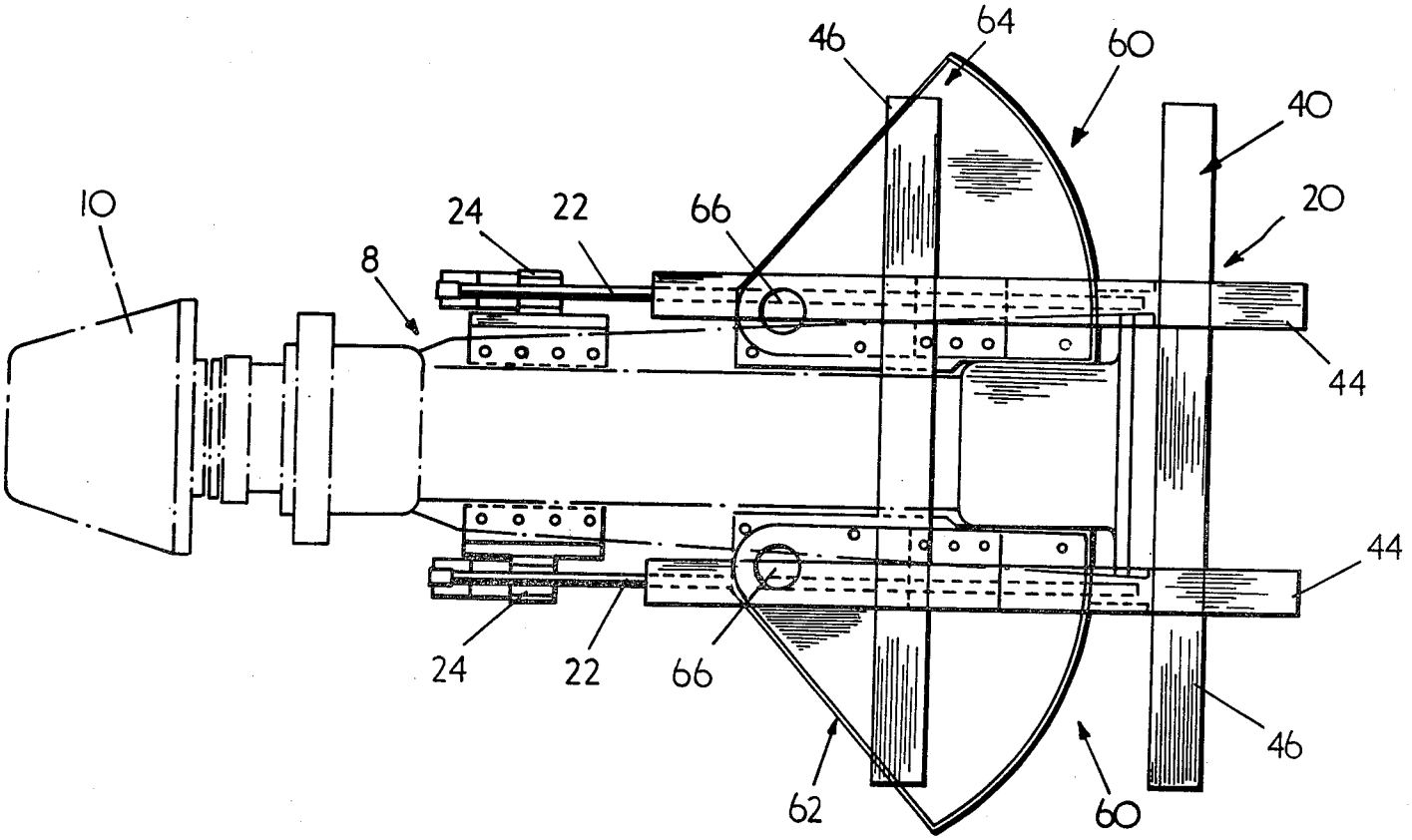
FIG. 3 is a plan view of FIG. 2.

A platform arrangement 60 (FIGS. 2 and 3) in two parts 62, 64 is provided and is mounted on the boom 8. Each part 62, 64 is pivotted at pin 66 to the boom 8 and comprises three plates 68, 69 70, the lowermost plate 68 being fixed and the other two being movable in mutually parallel planes in relation to one another. In FIGS. 2 and 3, the platform arrangement 60 is depicted in its stowed position.

In use, when the mineral mining machine 1 is operating to remove material from an underground roadway or in ripping operations, the cutting head 10 is rotated, is advanced into the strata and the boom 8 is traversed over the area of strata to be cut, the boom moving in its trunnion mounting and on its turret 6. Once the machine 1 has advanced sufficiently for a support to be set to the roof, the boom 8 is positioned as shown in FIG. 1. The rams 30 on each side of the boom 8 are actuated to retract the rods 28 and so pivot the limbs 22 about the points 24 to swing the support member 40 in an anti-clockwise direction as viewed in the drawings from the position of FIG. 2 to that shown in FIG. 1 in which the support structure 20 extends orthogonal or substantially orthogonal to the longitudinal axis of the boom 8 and is upstanding therefrom. The support member 40 abuts a face (not shown) in the tunnel or roadway, for example a ripping face, the machine 1 being maintained stationary. The support structure 20 thus provies a temporary support for the face and a protection for operatives to set an arch support referenced generally at 70.

Each support 70 includes a crown section 72 and this has to be elevated to a position adjacent the roof (not shown). For this purpose the lifting mechanism 50 is provided. The crown section 72 is carried by the portion 52 at 74, the rams 55, 57 being actuated to elevate the section 72 to the position shown in FIG. 1. During the arch-setting operation, the platform arrangement 60 may conveniently be brought into use and is extended to its operational area merely by rotating plates 69, 70 about the pins 66 and sliding them in relation to one another to give a substantially semi-circular base platform on either side of the boom 8.

By using the present invention, operatives can work on the arch-setting operation in comparative safety because of the face support structure provided on the boom, and are saved the laboriousness of setting the previously known face support.

What is claimed is:

1. A mineral mining machine includes a mobile base unit, a forwardly extending cutter-carrying boom mounted on the base unit and adapted for vertical and horizontal movement, a conveyor assembly attached to the base unit and extending from the front of the unit to the rear thereof, the conveyor unit being adapted to collect and convey material at the front of the unit to the rear of the unit for discharge, and a face support structure pivotally attached to the boom and being adapted for movement independently of the movement of said boom between an inoperative position adjacent the boom and a face supporting position orthogonal or substantially orthogonal to the longitudinal axis of the boom.

2. A machine according to claim 1 including power-operated means adapted to move the face support structure independently of the boom.

3. A machine according to claim 2 in which the power-operated means are fluid operable rams.

4. A machine according to claim 1 in which the structure includes two limbs, one located on either side of the boom and each pivotally attached thereto.

5. A machine according to claim 4 in which the structure includes a support member hinged to the two limbs and, in use, adapted to provide an abutment for engagement with a face to be supported.

6. A machine according to claim 1 including a lifting mechanism pivotally mounted on the boom, and actuating means for moving the lifting mechanism relative to the boom.

7. A machine according to claim 1 including a platform arrangement mounted on the boom.

8. A machine according to claim 7 in which the platform arrangement is in two parts, each part being disposed at one side of the boom.

9. A machine according to claim 8 in which each part of the platform arrangement comprises a number of plates relatively movable with respect to one another in mutually parallel planes.

10. A machine according to claim 9 in which a substantial portion of each plataform arrangement part is stowable.

11. A machine according to claim 9 in which the plates are pivotally mounted on the boom.

* * * * *